United States Patent [19]

Hollweck

[11] 4,366,462

[45] * Dec. 28, 1982

[54] TEMPERATURE SAFETY SWITCH

[75] Inventor: Walter Hollweck, Nuremberg, Fed. Rep. of Germany

[73] Assignee: Inter Control Hermann Köhler Elektrik GmbH & Co. KG, Nuremberg, Fed. Rep. of Germany

[ * ] Notice: The portion of the term of this patent subsequent to Dec. 22, 1998, has been disclaimed.

[21] Appl. No.: 198,611

[22] Filed: Oct. 20, 1980

[30] Foreign Application Priority Data

Oct. 20, 1979 [DE] Fed. Rep. of Germany ..... 2942478

[51] Int. Cl.[3] ..... H01H 37/76

[52] U.S. Cl. ..... 337/409

[58] Field of Search ..... 337/401–403, 337/407–409, 414, 415

[56] References Cited

U.S. PATENT DOCUMENTS

| | | | |
|---|---|---|---|
| 1,159,602 | 11/1915 | Schever | 337/409 |
| 2,997,562 | 8/1961 | Hathaway | 337/403 |
| 4,189,697 | 2/1980 | Hara | 337/407 |
| 4,307,370 | 12/1981 | Hollweck | 337/407 |

FOREIGN PATENT DOCUMENTS 2012426 9/1970 Fed. Rep. of Germany .

*Primary Examiner*—William H. Beha, Jr.
*Attorney, Agent, or Firm*—Spencer & Kaye

[57] ABSTRACT

A temperature responsive safety switch including an insulating housing provided with a recess, a pair of electrically conductive contact elements mounted in the housing and defining an electric current path extending through the housing, one of the contact elements being a spring element which is internally stressed to tend to separate from the other contact element, a solder body, a plunger displaceably mounted in the housing and supported between the body and the spring element to maintain the contact elements in contact with one another when the body has not melted, and a hollow cylindrical sleeve member mounted in the housing recess and enclosing the solder body and which is oriented in the displacement direction of the plunger, the end of the plunger remote from the contact spring extending into the sleeve member with play in the direction perpendicular to the longitudinal axis of the sleeve member, and recess presenting a space around the sleeve member sufficient to receive the entire mass of solder when the solder melts and is forced out of the sleeve member by displacement of the plunger.

4 Claims, 3 Drawing Figures

TEMPERATURE SAFETY SWITCH

BACKGROUND OF THE INVENTION

The present invention relates to a temperature responsive safety switch, fuse, or circuit breaker, of the type having a meltable insert melting of which opens the switch.

Temperature responsive safety switches including a meltable solder insert are known in general and are disclosed, for example in German Auslegeschrift [Published Patent Application] No. 2,012,426. In another prior art temperature responsive safety switch of the type under consideration, the meltable solder insert comprises a meltable solder in the form of a round disc or wafer which is fastened in a recess of a housing of insulating material and bridges an opening in a heat transfer plate made of a material having good thermal conductivity. The diameter of this opening is larger than the diameter of an actuating plunger which rests on the upper side of the disc. When there is enough heat to cause the solder to melt such melting has the result of eliminating the cover over the opening, since that cover was constituted by the solder disc. Due to the force of the contact spring and simultaneous interruption of the electric current path, the actuating plunger is then pressed into the opening in the heat transfer plate.

The drawback of this prior art temperature responsive safety switch is its poor service life. This has a disadvantageous effect on its use as a temperature responsive fuse. Although the particular alloy composition of the melting solders employed leads to the expectation that a defined melting point exists, the solder will soften somewhat before such melting temperature is reached. That means that if there is a long duration heating influence, but at a temperature below the intended actuation temperature, the melting solder will lose firmness, as a result of which the force exerted by the contact spring on the actuating plunger may lead to premature opening of the temperature responsive fuse. Moreover that the melting solder is essentially exposed to the atmosphere which is a drawback since the presence of oxygen may change the melting point of some solders.

SUMMARY OF THE INVENTION

It is an object of the present invention to provide a temperature responsive safety switch of the above-mentioned type which avoids the above-described drawbacks.

A more specific object of the invention is to construct the temperature responsive safety switch in such a way that variations in its response temperature are reduced and the design temperature is maintained over a long period of time.

These and other objects are achieved, according to the invention, in a temperature responsive safety switch including an insulating housing provided with a recess, a thermally conductive heat transfer plate mounted on the housing, a pair of electrically conductive contact elements mounted in the housing and defining an electric current path extending through the housing, one of the contact elements being a spring element which is internally stressed to tend to separate from the other contact element, a body of meltable material mounted on the heat transfer plate, and a force-transmitting plunger displaceably mounted in the housing and having one end in engagement with the body of meltable material and its other end in engagement with the spring element to maintain the contact elements in contact with one another when the body of meltable material has not melted, by the provision of a hollow cylindrical sleeve member in which the solder body is enclosed and which is oriented with its longitudinal axis extending in the displacement direction of the plunger, the sleeve member and plunger being so positioned and dimensioned relative to one another that the end of the plunger remote from the contact spring extends into the sleeve member with play in the direction perpendicular to the longitudinal axis of the sleeve member, the sleeve member being mounted in the recess in the housing, and the housing recess being dimensioned to present a space around the sleeve member sufficient to receive the entire mass of the solder body when the solder melts and is forced out of the sleeve member by displacement of the plunger.

The present invention assures that solder, upon becoming softened or melted, cannot escape directly in the radial direction, i.e. perpendicular to the longitudinal axis of the actuating plunger. Rather it must first leave its sleeve at both ends in axial directions, i.e. parallel to the longitudinal axis and the direction of movement of the actuating plunger, before it can be displaced radially and will only then release the opening path for the actuating plunger or for the contact spring, respectively. Thus the melting solder, if it should soften due to long-lasting thermal stresses will be prevented by the sleeve from undergoing a reduction in its effective height as a result of a slow radial escape and from thus at least initiating the opening process. Before it reaches the temperature of its final melting point, it is essentially impossible for the melting solder to leave the two ends of the sleeve.

According to preferred embodiments of the invention, the recess in the housing is further dimensioned for presenting a space adjacent the end of the sleeve member which is directed toward the plunger. This makes it possible for the sleeve member to be automatically raised slightly from its support on the heat transfer plate so that the melting solder after having been liquefied can exit from both ends of the sleeve member and can be displaced in the radial direction out of the opening path of the actuating plunger.

According to a further feature of the invention, the sleeve member is formed to present an axial passage having a reduced cross section at the end thereof remote from the plunger. This offers the advantage that the effective passage cross sections for the liquefied melting solder at the upper and lower exits of the sleeve member can be matched to one another in such a way that the discharge of the liquefied melting solder from both sleeve ends begins practically at the same time. In this way, the melting solder is prevented from prematurely leaving through the lower end of the sleeve member, which is adjacent to the heat transfer plate.

Preferably, the sleeve member includes a radially inwardly directed collar which defines the reduced cross section of the axial passage. This represents a particularly advantageous structural arrangement for achieving the desired reduced cross section. Moreover, this feature takes account of the fact that a temperature gradient is present between the end of the solder facing the heat transfer plate and the end facing the actuating plunger so that the solder is always somewhat colder and firmer in the region of the actuating plunger than in the region of the heat transfer plate.

The present invention thus accomplishes that the solder, upon melting, leaves both ends of the sleeve only after it has been substantially liquefied so that the contact spring performs its circuit opening movement with greater speed.

The structure according to the invention further encapsulates the melt body solder essentially against attacks of oxidation from the outside. Moreover, the heat transfer plate no longer need be provided with an opening for the passage of the actuating plunger.

DESCRIPTION OF THE PREFERRED EMBODIMENTS

Figure 1:
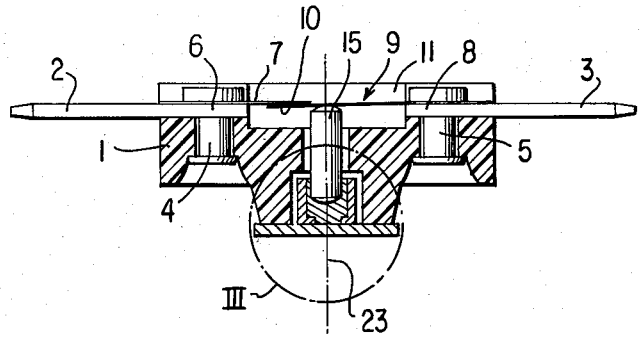
FIG. 1 is a cross-sectional, elevational view of a preferred embodiment of a temperature responsive safety switch according to the invention with the current path closed.
Figure 2:
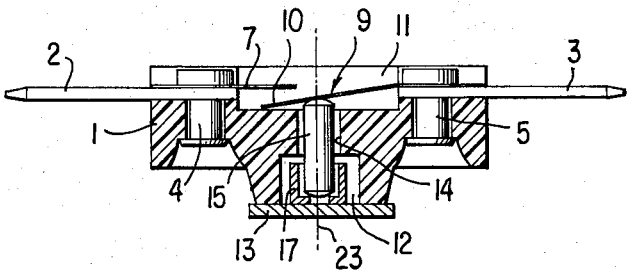
FIG. 2 is a view similar to that of FIG. 1 showing the same switch with the current path opened.
Figure 3:
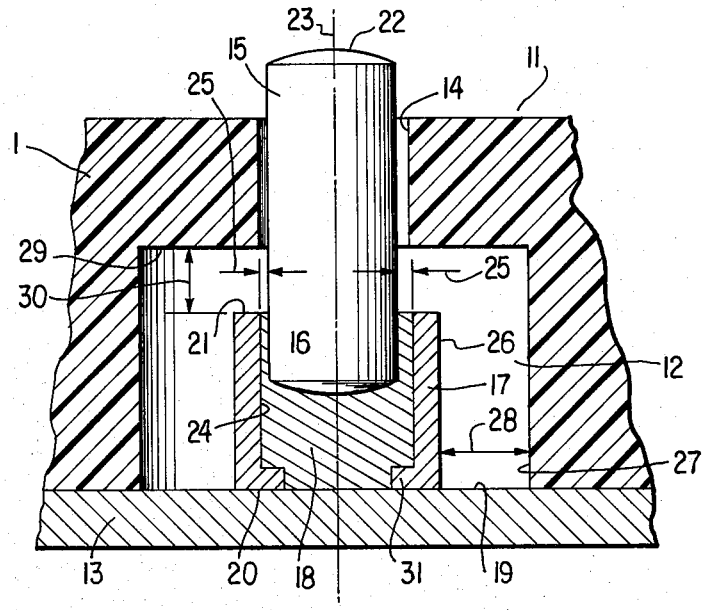
FIG. 3 is a cross-sectional detail view to an enlarged scale of the switch portion enclosed by circle III in FIG. 1.

The switch illustrated in FIGS. 1–3 includes an insulating housing 1 in which the electrical terminals 2 and 3 of a current path are fixed by rivets 4 and 5. The inner end 6 of the left-hand terminal 2 carries a stationary countercontact 7 which projects in the direction toward the right-hand terminal 3. Opposite thereto, the inner end 8 of the right-hand terminal 3 is provided with a contact spring 9 whose free end 10 lies below the countercontact 7. The contact spring 9 is under the influence of an internal deflecting force which urges its free end 10 downwardly into the open position shown in FIG. 2, in which the free end 10 would break contact with the countercontact 7. Contact spring 9 and countercontact 7 are here accommodated in an upper recess 11 in the insulating housing 1.

At its underside, the insulating housing is provided with a lower recess 12 whose lower opening is covered, or closed, by a heat transfer plate 13 having good thermal conductivity. The recesses 11 and 12 communicate via a channel 14 which is penetrated, or traversed, by the actuating plunger 15. The actuating plunger 15 has a substantially greater length than the channel 14 so that both its ends protrude far out of the channel. The lower end 16 of the actuating plunger 15 projects into the upper end of a sleeve 17 which, as best seen in FIG. 3, is filled with a mass of meltable solder 18 most of which is located below the lower end 16 of the plunger 15. The lower end 20 of solder mass 18 rests upon the inside 19 of the heat transfer plate 13. The upper end 21 of the sleeve 17 thus encloses the lower end 16 of the actuating plunger 15 with play.

When the solder mass 18 is still cold, as shown in FIGS. 1 and 3, the upper end 22 of the actuating plunger 15 rests against the underside of the contact spring 9 and holds its free end 10 in the closed position against the countercontact 7 of the left-hand terminal 2. Channel 14 has such dimensions that the actuating plunger 15 can be freely displaced in the insulating housing 1 in the direction of the plunger longitudinal axis 23. Between the periphery of the lower end of the actuating plunger 15 and the inner wall 24 of the sleeve 17, there remains an annular gap 25 which is sufficiently large to permit the liquefied, melted solder 18 to pass out of the sleeve.

Between the outer wall 26 of the sleeve 17 and the inner wall 27 of the recess 12 facing wall 26 there is sufficient space 28 to completely accommodate the solder 18 after it has melted and been displaced out of the sleeve 17. A sufficient space 30 is likewise provided between the upper end 21 of the sleeve 17 and the upper delimiting wall 29 of the recess 12 to allow sleeve 17 to be automatically lifted up while plunger 15 is pressing downwardly on molten solder, to thereby enable solder to also exit via the bottom of sleeve 17.

At its lower end 20, the sleeve 17 is provided with an annular collar 31 which is fixed to or integral with its inner wall 24 and projects radially inwardly therefrom. Thus the passage cross section for molten solder at the lower end 20 of the sleeve 17 is reduced in size.

If, due to heating, particularly of the heat transfer plate 13, the melting point of the solder 18 is reached, the solder 18 liquefies. Under the influence of the internal force contact spring 9, the actuating plunger 15 is pressed downwardly, penetrating deeper into the sleeve 17. This causes the low viscosity, flowing molten solder 18 to be displaced and to escape past the upper end 21 and the lower end 20 of the sleeve, initially axially downwardly and upwardly, and then radially into the free space of the recess 12 while slightly raising the sleeve from the heat transfer plate. The stroke of the actuating plunger 15 is here dimensioned in such a manner that opening of the current path between the electric terminals 2, 3 is assured with certainty.

According to one typical embodiment, the solder body can consist of 82.5% lead and 17.5 cadmium and have a melting point of 248° C.

In one typical embodiment, plunger 15 can have an outer diameter which is 0.1 to 0.2 mm smaller than the inner diameter of sleeve 17.

It will be understood that the above description of the present invention is susceptible to various modifications changes and adaptations, and the same are intended to be comprehended within the meaning and range of equivalents of the appended claims.

What is claimed is:

1. In a temperature responsive safety switch including an insulating housing provided with a recess, a thermally conductive heat transfer plate mounted on the housing, a pair of electrically conductive contact elements mounted in the housing and defining an electric current path extending through the housing, one of the contact elements being a spring element which is internally stressed to tend to separate from the other contact element, a body of meltable material mounted on the heat transfer plate, and a force-transmitting plunger displaceably mounted in the housing and having one end in engagement with the body of meltable material and its other end in engagement with the spring element to maintain the contact elements in contact with one another when the body of meltable material has not melted, the improvement comprising:

a hollow cylindrical sleeve member in which said body of meltable material is enclosed and which is oriented with its longitudinal axis extending in the displacement direction of said plunger, said sleeve member and plunger being so positioned and dimensioned relative to one another that the end of said plunger remote from said contact spring extends into said sleeve member with play in the direction perpendicular to the longitudinal axis of said sleeve member, said sleeve member being mounted in said recess in said housing, and said housing recess being dimensioned to present a space around said sleeve member sufficient to receive the entire mass of said body when the material melts and is forced out of said sleeve member by displacement of said plunger.

2. An arrangement as defined in claim 1 wherein said recess in said housing is further dimensioned for presenting a space adjacent the end of said sleeve member which is directed toward said plunger.

3. An arrangement as defined in claim 1 or 2 wherein said sleeve member is formed to present an axial passage having a reduced cross section at the end of said sleeve member directed away from said plunger.

4. An arrangement as defined in claim 3 wherein said sleeve member includes a radially inwardly directed collar which defines the reduced cross section of said axial passage.

* * * * *